US005632711A

United States Patent [19]

Hwang

[11] Patent Number: 5,632,711

[45] Date of Patent: May 27, 1997

[54] TWISTER

[76] Inventor: Yu-Yeh Hwang, 5F-23, 70, Fu-Shing Road, Taoyuan, Taiwan

[21] Appl. No.: 674,547

[22] Filed: Jul. 2, 1996

[51] Int. Cl.[6] ..... A63B 22/14

[52] U.S. Cl. ..... 482/147; 482/146

[58] Field of Search ..... 482/51, 57, 146, 482/147, 148

[56] References Cited

U.S. PATENT DOCUMENTS

| | | | |
|---|---|---|---|
| 4,313,603 | 2/1982 | Simjian | 482/147 |
| 4,391,441 | 7/1983 | Simjian | 482/147 X |
| 4,638,996 | 1/1987 | Simjian | 482/147 |
| 5,545,111 | 8/1996 | Wang et al. | 482/147 X |

*Primary Examiner*—Stephen R. Crow
*Assistant Examiner*—William LaMarca
*Attorney, Agent, or Firm*—Bacon & Thomas

[57] ABSTRACT

An improved twister includes a base frame, a rocker, a hydraulic cylinder, a link and a rotatable disk. The base frame is provided with a pivot seat and two upright bars, the pivot seat being pivotally mounted on the rotatable disk and the upright bars being pivotally connected to the rocker. The rocker is connected to a grip link at a top end and two substantially C-shaped frame at a bottom side. The hydraulic cylinder is pivotally mounted on the base frame and has a shaft with a pivot head pivotally connected to one of the C-shaped frames. The link has one end pivotally connected to the other of the C-shaped frames and the other end coupled to a pivot shaft of the rotatable disk. To operate, the user stands on the rotatable disk with both hands holding the grip link and pulling the rocker so as to cause the link to rotate the rotatable disk. Working in conjunction with the hydraulic cylinder which provides a damping force, the twister permits the user to exercise various parts of the body.

1 Claim, 7 Drawing Sheets

TWISTER

BACKGROUND OF THE INVENTION (a) Field of the Invention:

The present invention relates generally to a twist disk, and more particularly to an improved twist disk utilizing the weight of the user to achieve various exercising effects.

(b) Description of the Prior Art:

With reference to FIG. 1, a conventional twister 1' essentially comprises a base 11', a handle 12' extended and mounted on the base 11' and a rotatable disk 13' disposed above the base 11'. The user works the twister 1' by standing on the disk 13' with both hands holding the handle 12' and using both feet to twist the disk 13', thereby achieving the object of exercising the waist and the abdominal muscles. However, such a conventional twister is not only monotonous in terms of function but also not very effective in terms of exercising effects.

SUMMARY OF THE INVENTION

According to a first aspect of the present invention, there is a good linking-up movement between a rocker and rotatable disk of the improved twister so that movement of the rocker may drive the disk to rotate, and hence, when the user stands on the disk, his/her weight may be effectively utilized to permit various exercising patterns to obtain optimum exercising effects.

According to a second aspect of the present invention, a hydraulic cylinder may be pivotally disposed between the rocker and a base frame of the improved twister so that when the rocker is pulled by the user, the hydraulic cylinder may provide a damping force to achieve better exercising effects.

According to a third aspect of the present invention, a pair of rotatable pedals may be pivotally mounted on the rotatable disk of the improved twister to allow the user to twist through 360 degrees, affording more fun in using the twister.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
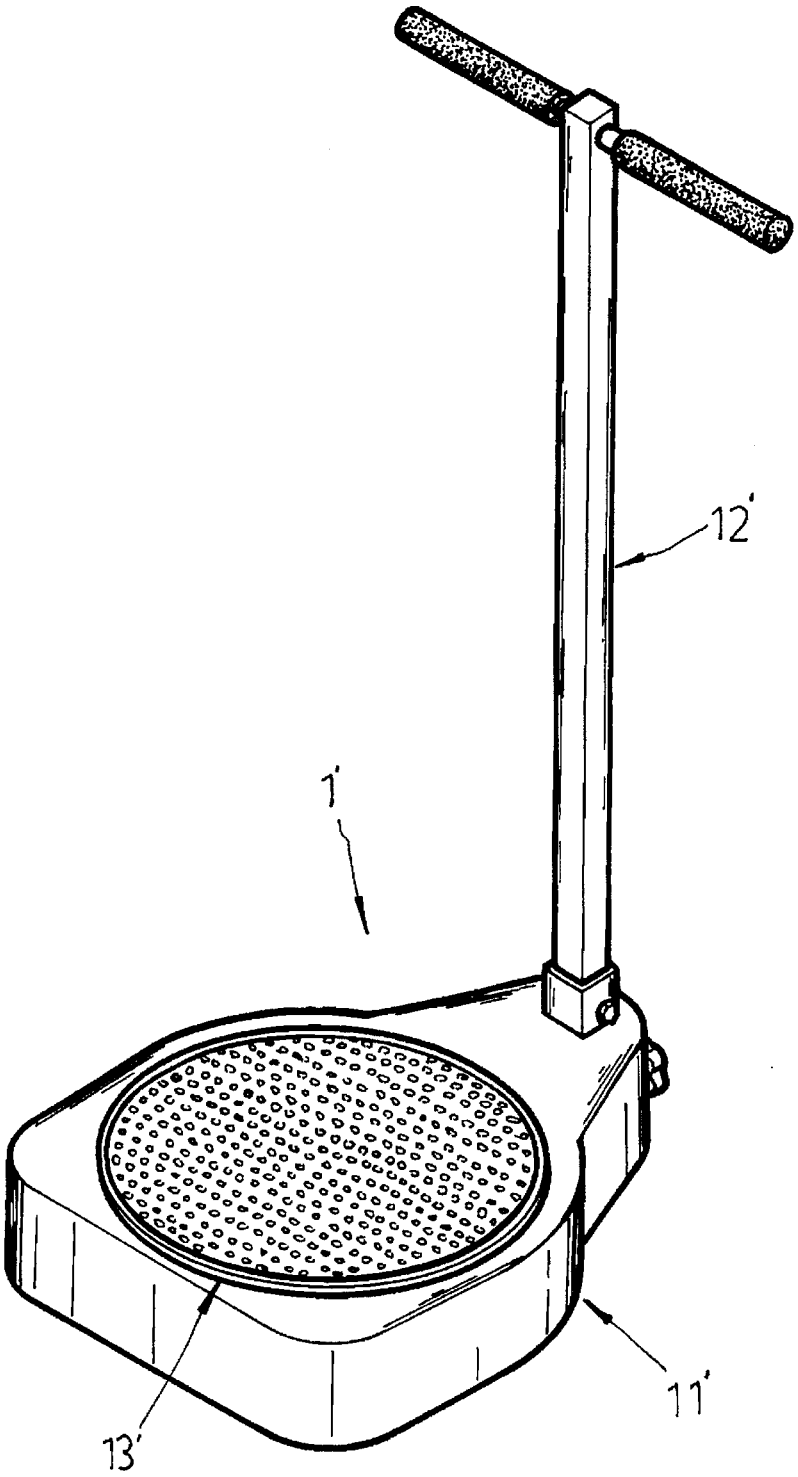
Prior Art FIG. 1
FIG. 1 is a schematic view of a conventional twister.
Figure 2:
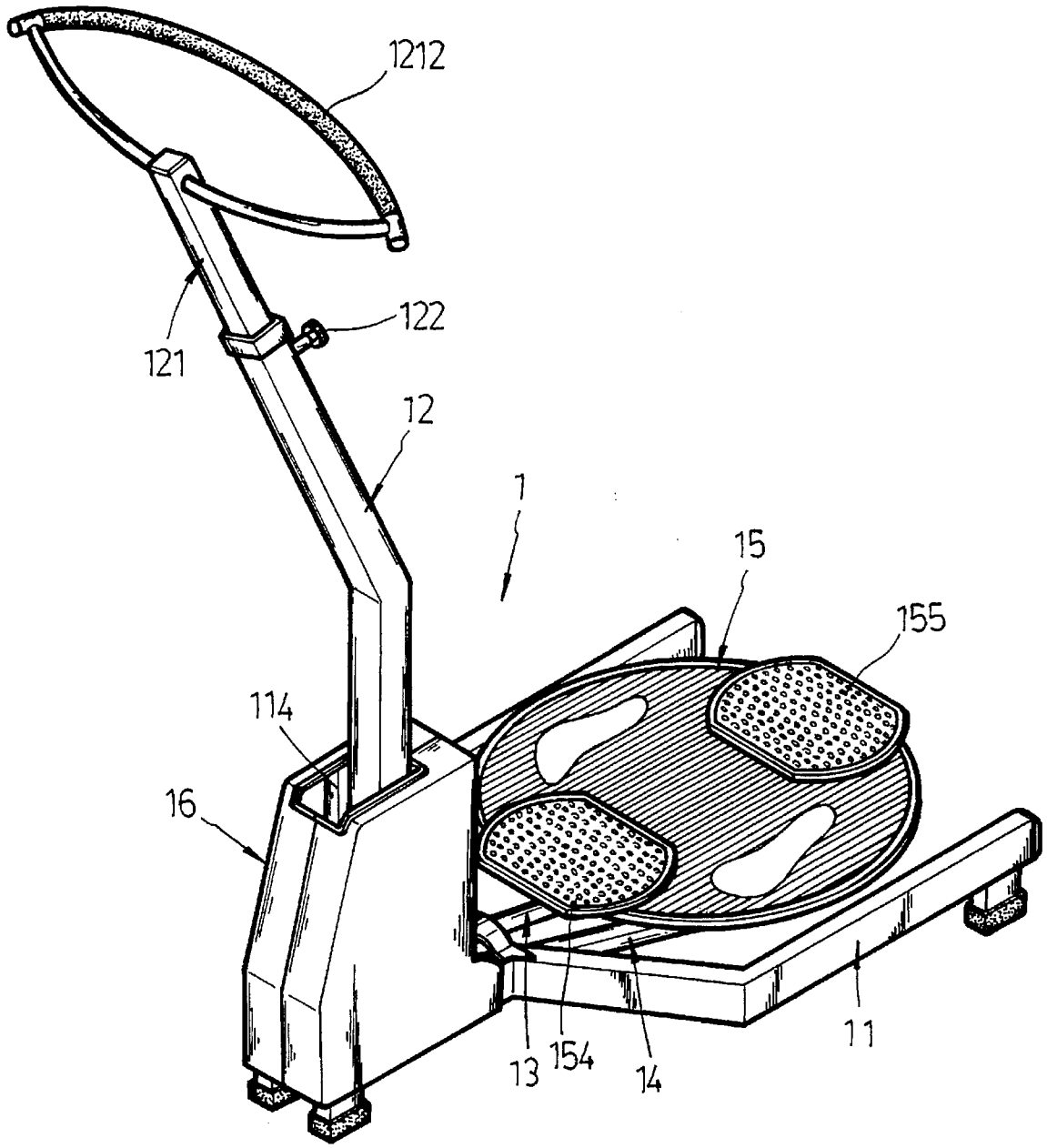
FIG. 2 is a elevational view of the improved twister of the present invention.
Figure 3:
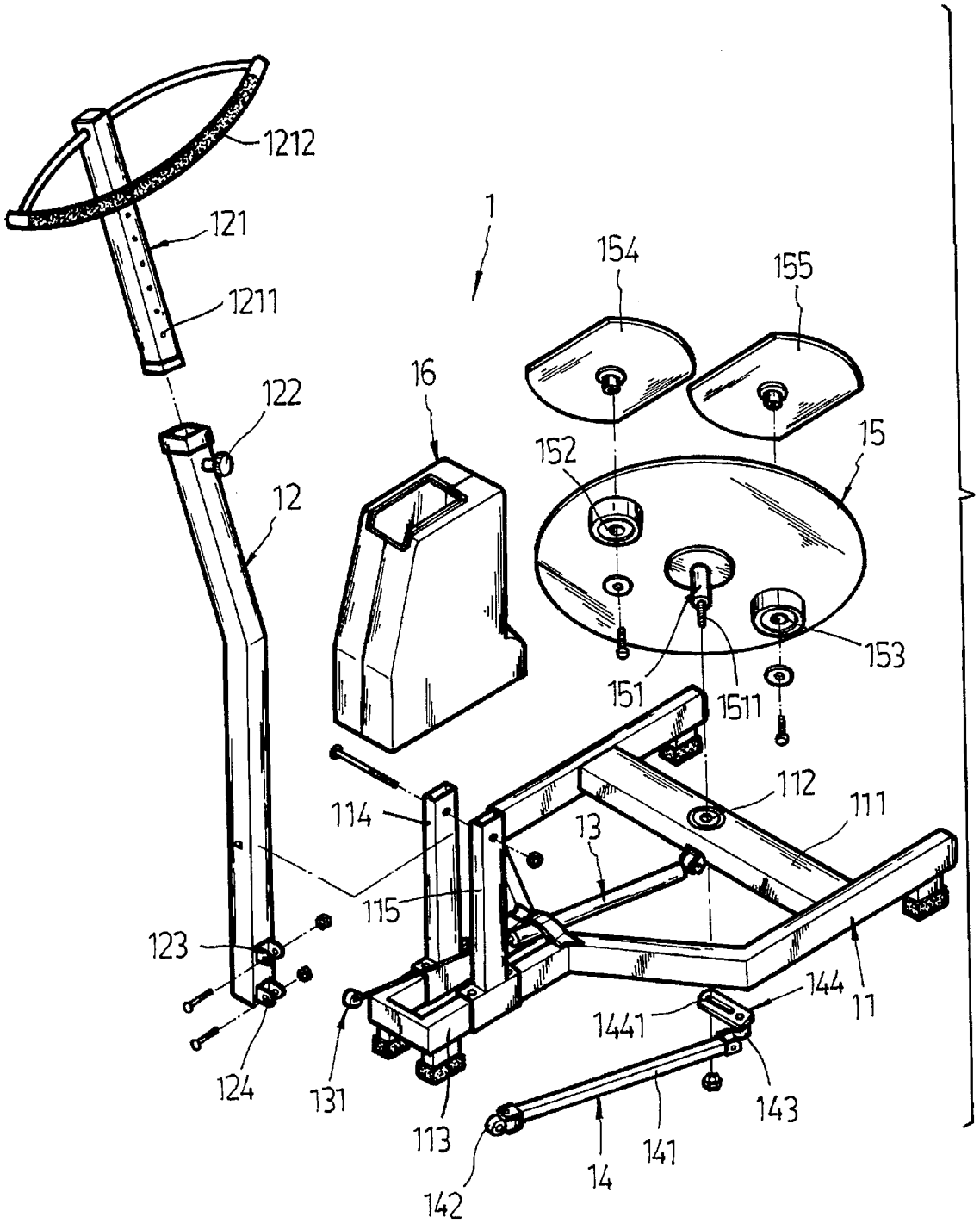
FIG. 3 an elevational exploded view of the improved twister of the present invention.

With reference to FIGS. 2 and 3, a twister 1 of the present invention essentially comprises a base frame 11, a rocker 12, a hydraulic cylinder 13, a link 14 and a rotatable disk 15. The base frame 11 has a pivot seat 112 located at the middle of an intermediate horizontal bar 111 and two parallel, side-by-side upright bars 114 and 115 mounted on a raised frame 113 at a front end thereof. The rocker 12 is pivotally disposed between the upright bars 114 and 115 so that the rocker 12 may swing back and forth in the raised frame 113. A front end of the rocker 12 is fitted with a grip link 121 and is fixedly connected to a retain element 122. On that side of the grip link 121 facing the retain element 122, there are provided a series of adjusting holes 1211 which are spaced apart from each other so that the retain element 122 may be received in any one of the adjusting holes 1211. Such an arrangement allows the user to adjust the position of the grip link 121 on the rocker 12. The grip link 121 has a crescent shaped handle 1212 at a top end thereof for gripping purposes. At a bottom side of the grip link 121, there are two substantially C-shaped frames 123 that are spaced apart from each other and respectively located near the upper end and the lower end. The hydraulic cylinder 13 is pivotally mounted in front of the intermediate horizontal bar 111 of the base frame 11. The hydraulic cylinder 13 has a pivot head 131 on its shaft, the pivot head 131 being pivotally connected to the C-shaped frame 123 near the upper end of the bottom side of the rocker 12 to provide a damping force when the rocker 12 swings.

Furthermore, the link 14 has an extended arm 141 the ends of which are respectively provided with movable connectors 142, 143. The latter is pivotally provided with a retain plate 144, while the former has one end pivotally connected to the C-shaped frame 124 near the lower end of the bottom side of the rocker 12. The retain plate 144 of the movable connector 143 has an elongated slot 1441 at a central position. The rotatable disk 15 has a pivot shaft 151 at the center of its bottom side. The pivot shaft 151 is pivotally received in the pivot seat 112 of the base frame 11 so that the rotatable disk 15 may freely turn. The pivot shaft 151 is provided with a screw pin 1511 projecting from a bottom end thereof for insertion into the elongated slot 1411 of the retain plate 144, the screw pin 1511 having two planar lateral sides. A nut may be locked onto the screw pin 1511 so that the screw pin and the retain plate 144 may be coupled and linked together.

Figure 4:
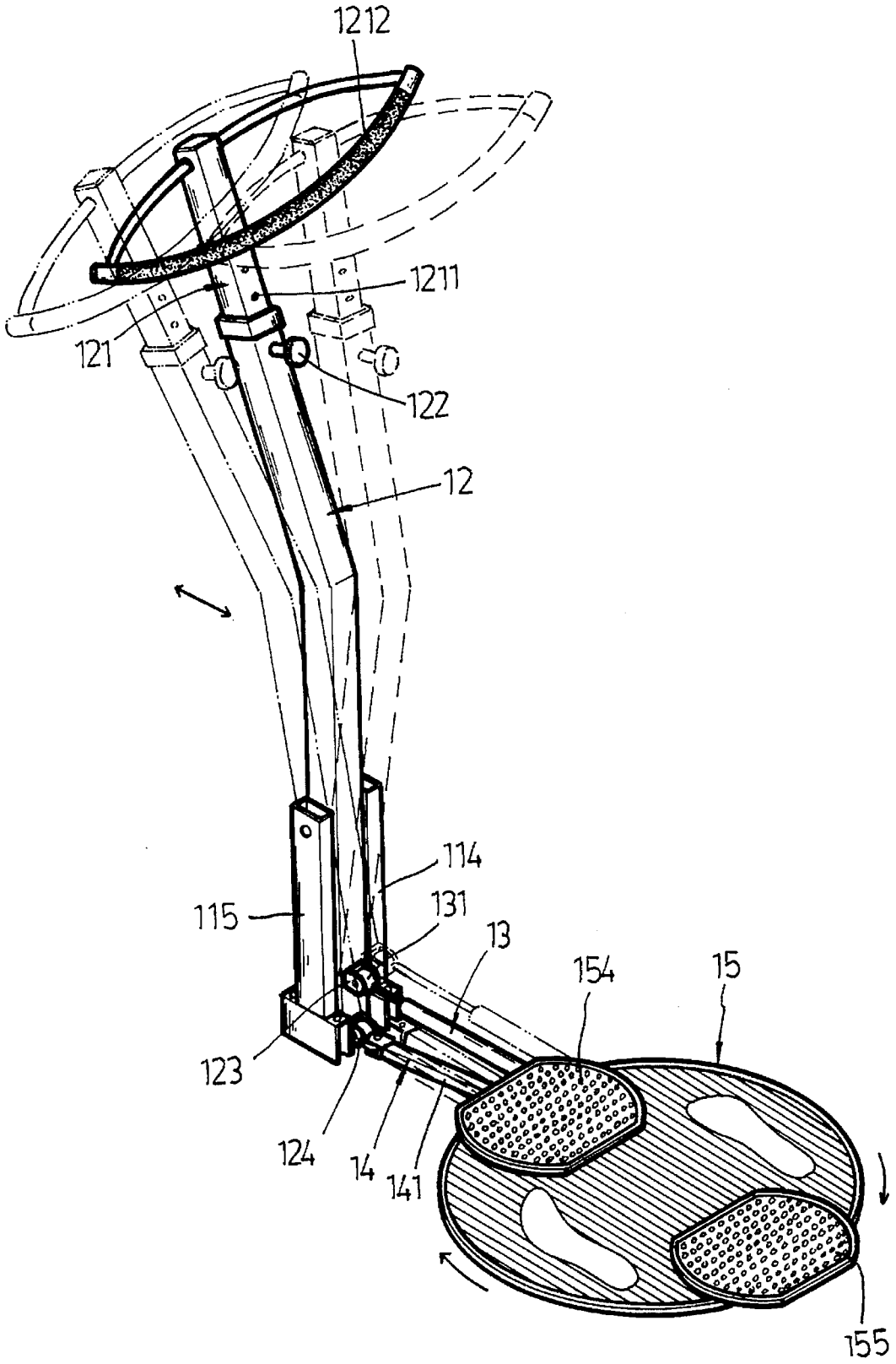
FIG. 4 is a schematic view illustrating the relationship of relevant components of the improved twister of the present invention.

With reference to FIG. 4, when the rocker 12 is pulled to swing, the link 14 may be pulled synchronously to drive the rotatable disk 15. The extent of the swinging of the rocker 12 may be adjusted by means of position of the screw pin 1511 in the elongated slot 1411 of the retain plate 144. In addition, the rotatable disk 15 is provided with two matching pivot seats 152 and 153 on a top side thereof. Two rotatable pedals 154 and 155 are pivotally mounted on the pivot seats 152 and 153 respectively. A protective shell 16 may be mounted between the upright bars 114 and 115 of the base frame 11 so that the the rocker 12 may be prevented from hurting the user when it swings between the upright bars 114 and 115.

Figure 5:
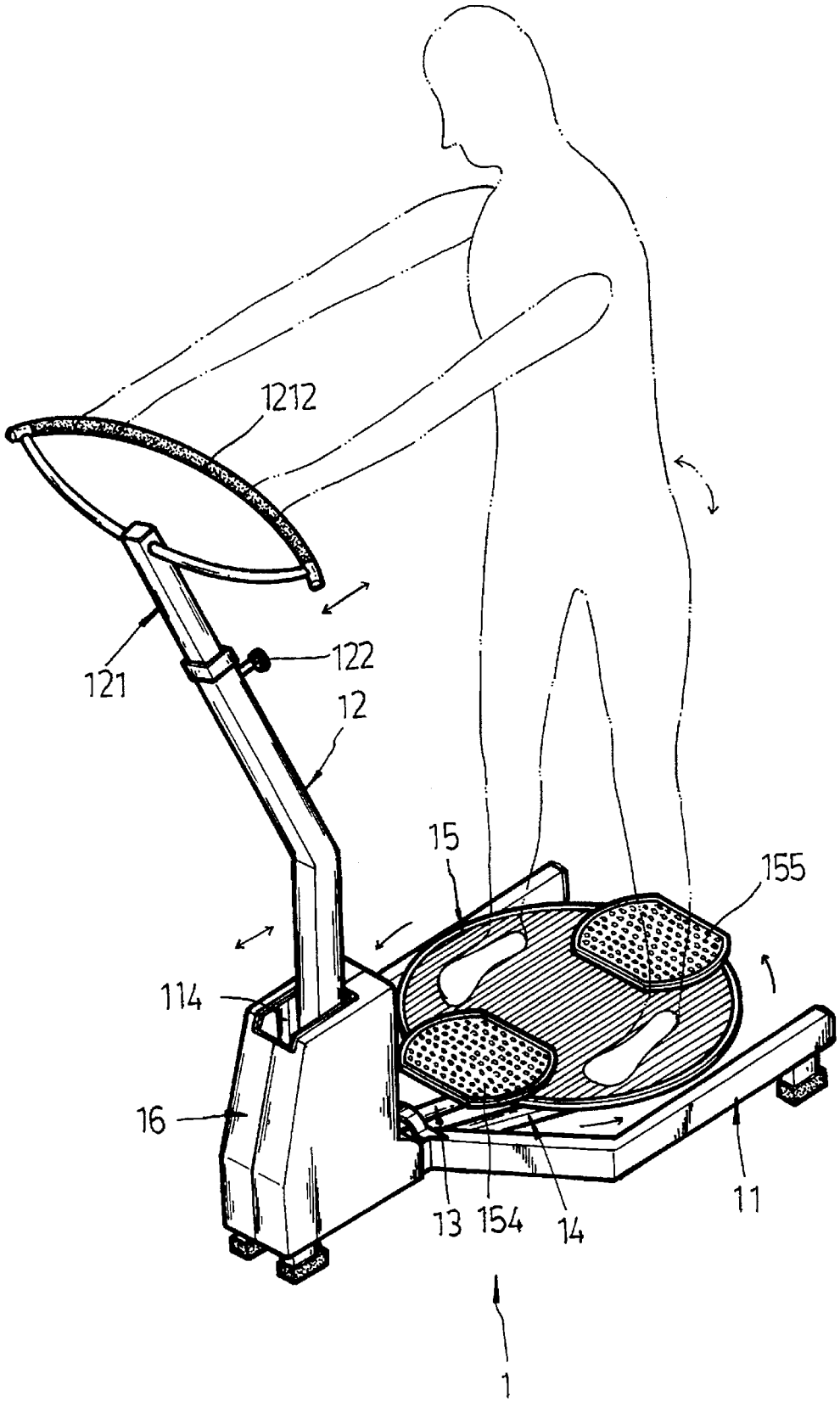
FIG. 5 illustrates a first example of using the improved twister of the present invention.

Referring to FIG. 5, when the user stands on the rotatable disk 15 with both hands holding the handle 1212 of the grip link 121 and pulls the rocker 12 to swing back and forth, forcing the link 14 to drive the rotatable disk to turn cyclically, the user may exercise the muscles of the hands, chest, waist as well as the abdomen by twisting, utilizing the weight of the user and the damping force of the hydraulic cylinder 13 as resistance. In this way, the user may exercise various parts of the body.

Figure 6:
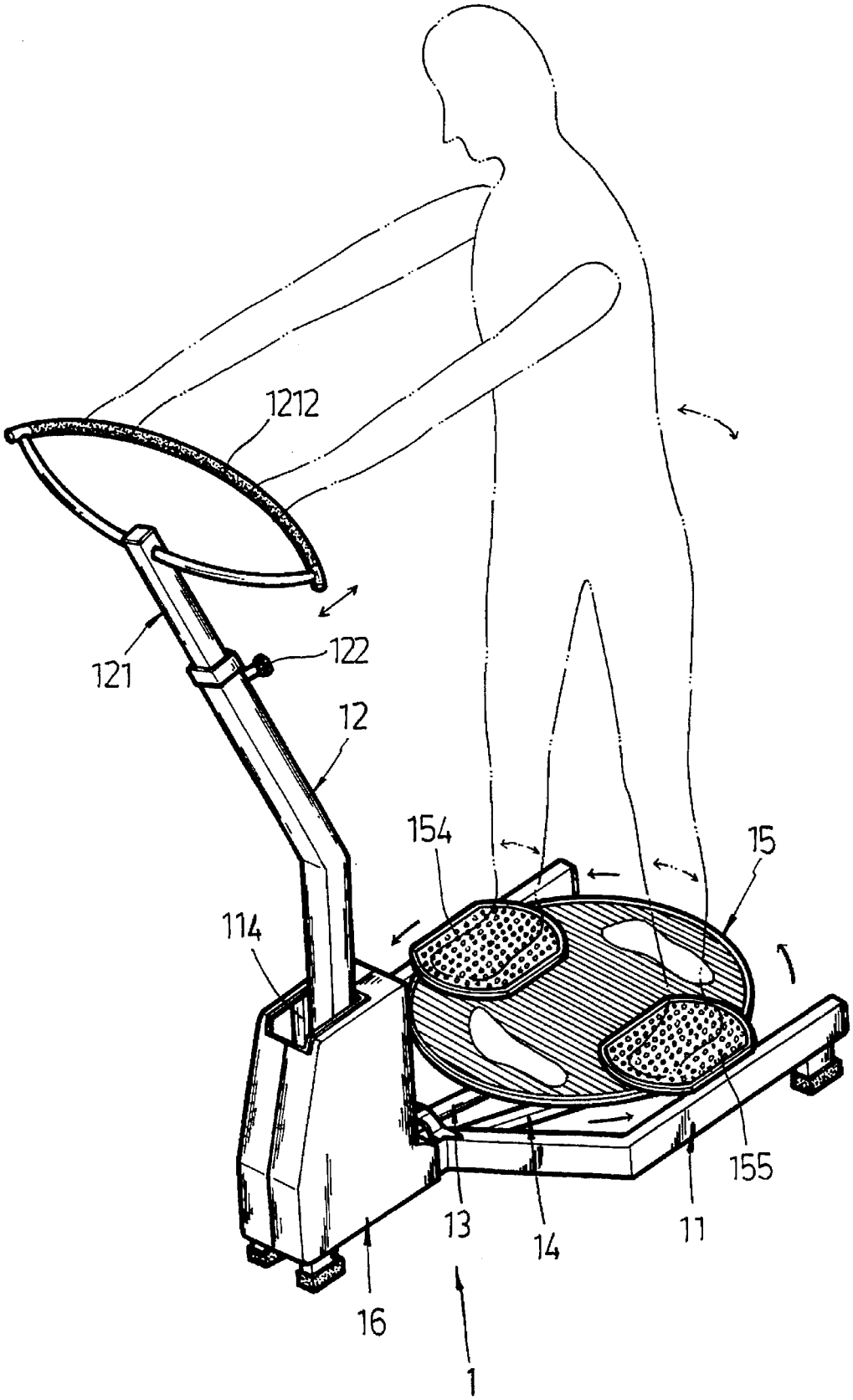
FIG. 6 illustrates a second example of using the improved twister of the present invention.
Figure 7:
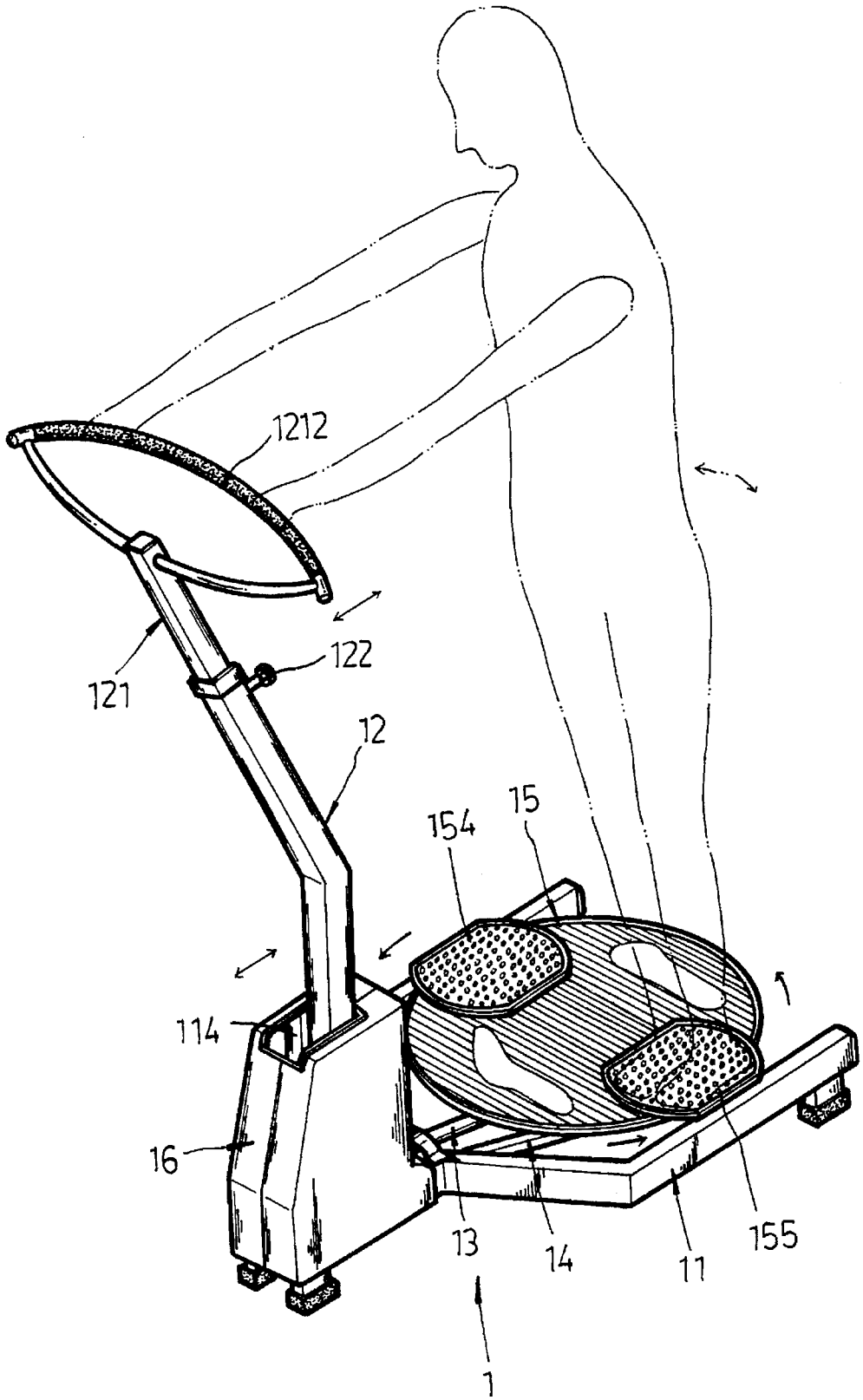
FIG. 7 illustrates a third example of using the improved twister of the present invention.

With reference to FIG. 6, the user may place both feet on the pedals 154, 155 of the rotatable disk 15 and operate the twister in the manner described above so that the user's feet may simultaneously perform twisting motion. Referring to FIG. 7, the user may place only one foot on one of the pedals 154 or 155 and turn through 360 degrees, enhancing the fun in using the twister.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved twister, comprising:

a base frame having a pivot seat at the middle of an intermediate horizontal bar and two parallel, side-by-side upright bars mounted on a raised frame at a front end thereof;

a rocker pivotally disposed between said upright bars to swing therebetween, said rocker having a grip link fitted at a top end thereof and two substantially C-shaped frames at a bottom side thereof, said C-shaped frames being spaced apart from each other near an upper end and a lower end of the bottom side of said rocker;

a hydraulic cylinder pivotally disposed at a front side of said intermediate horizontal bar of said base frame;

said hydraulic cylinder having a shaft that has a pivot head pivotally connected to the C-shaped frame near the upper end of the bottom side of said rocker;

a link having an extended arm with a front end and a rear end both of which are pivotally provided with a movable connector, the movable connector at said rear end being pivotally provided with a retainer plate and the movable connector at said front end being pivotally connected to the C-shaped frame near the lower end of the bottom side of said rocker, said retainer plate having an elongated slot at a central portion thereof; and a rotatable disk having a pivot shaft at the center of a bottom side thereof, said pivot shaft being pivotally received in said pivot seat of said base frame and capable of free rotation therein, said pivot shaft having a screw pin projecting from a bottom end thereof for insertion into said elongated slot of said retainer plate to be locked with a nut so that said pivot shaft and said retainer plate may be coupled and linked together for driving said rotatable disk to rotate when said rocker swings;

wherein said rotatable disk is rotated by said link when a user, standing on said rotatable disk, holds said grip link and pulls said rocker with both hands to cause said rocker to swing and in turn said link to drive said rotatable disk.

* * * * *